United States Patent [19]

Yuito

[11] Patent Number: 4,982,104

[45] Date of Patent: Jan. 1, 1991

[54] WEB DRIVE CONTROL APPARATUS

[75] Inventor: Fumio Yuito, Shizuoka, Japan

[73] Assignee: Fuji Photo Film Co., Ltd., Kanagawa, Japan

[21] Appl. No.: 385,434

[22] Filed: Jul. 27, 1989

[30] Foreign Application Priority Data

Jul. 29, 1988 [JP] Japan ..... 63-190083

[51] Int. Cl.[5] ..... G01N 21/89; B65H 26/02

[52] U.S. Cl. ..... 250/562; 226/33; 356/430

[58] Field of Search ..... 250/562, 563, 572; 226/24, 33, 43, 44, 45; 242/57; 356/430, 431, 237

[56] References Cited

U.S. PATENT DOCUMENTS

| | | | |
|---|---|---|---|
| 2,904,174 | 9/1959 | Emerson . | |
| 3,589,817 | 6/1971 | Sugaya . | |
| 3,806,015 | 4/1974 | Kachioff et al. | 226/33 |
| 4,078,487 | 3/1978 | McComb . | |
| 4,078,738 | 3/1978 | Nakamura . | |
| 4,728,800 | 3/1988 | Surka | 356/430 |

FOREIGN PATENT DOCUMENTS

| | | |
|---|---|---|
| 51-14039 | 5/1976 | Japan . |
| 56-43156 | 4/1981 | Japan . |
| 61-106372 | 5/1986 | Japan . |
| 61-114971 | 6/1986 | Japan . |
| 1-87460 | 3/1989 | Japan . |

*Primary Examiner*—Edward P. Westin
*Attorney, Agent, or Firm*—Young & Thompson

[57] ABSTRACT

A web drive control apparatus for continuously driving a web at a constant speed and stopping it at a desired position along a web drive line, comprises a web surface inspector for detecting a predetermined significant surface condition of a surface of the web. This inspector outputs an appropriate electric signal as a timing signal and a drive controller causes the web drive to start a deceleration of the web upon receiving the timing signal so as to stop part of the web where the significant surface condition is detected at a predetermined station along the web drive line. An activator, which is manually turned on and off, is provided to provide the line controller with an activation signal to enable the line controller to perform the decleration of the web.

7 Claims, 3 Drawing Sheets

WEB DRIVE CONTROL APPARATUS

FIELD OF THE INVENTION

The present invention relates to a web drive controlling apparatus, and more particularly to a controlling apparatus for decelerating and stopping a web driven at a constant speed at a predetermined position along a drive line upon the provision of a surface defect signal.

BACKGROUND OF THE INVENTION

Examples of surface inspection systems for various web materials such as aluminum or plastic sheets of indeterminate length, which photoelectrically scan the surface of the material with a flying spot of light, are disclosed in U.S. Pat. Nos. 3,589,817 and 2,904,174. When applying such an inspection system to a web drive so as to inspect a surface of a web material which is continuously driven, an inspection beam scans the web surface and the light either reflected from or passed through the web surface is collected to evaluate the quality of the web surface. If a surface defect is detected, a marker is actuated so as to mark that part of the web material that contains the surface defect. The web material is stopped when the marked part of the web material reaches a specified position where a visual inspection is to be made for deciding whether the surface defect is acceptable

OBJECT OF THE INVENTION

It is, therefore, an object of the present invention to provide a web drive controlling apparatus in which a web driven at a constant speed can be stopped precisely at a predetermined position along a web drive line.

SUMMARY OF THE INVENTION

To achieve the above object, the present invention provides a web drive controlling apparatus for continuously driving a web at a constant speed and stopping it at a predetermined position along a web drive line where an operation, such as a visual inspection or processing of the surface of the web, takes place. The apparatus has web surface inspection means for detecting a predetermined significant surface condition of a surface of the web and for outputting an appropriate electric signal as a timing signal, controlling means for starting a deceleration of the web upon receiving the timing signal so as to stop that part of the web where the significant surface condition is detected by the web surface inspection means at a predetermined station along the web drive line, and activating means for providing the controlling means with an activation or authorization signal to enable the controlling means to effect the deceleration of the web.

The activating means is adapted to turn active or inactive. If the part of the web where a surface defect or defects are detected need be either visually inspected or processed, the activating means is previously turned on to provide the activation or authorization signal. Then the controlling means effects deceleration of the web so as to stop the web at the position for visual inspection or surface processing. On the other hand, if no visual inspection or surface processing is needed, the activating means is previously turned off so as to continue driving the web at a constant speed even when surface defects are detected.

DETAILED DESCRIPTION OF THE INVENTION

Figure 1:
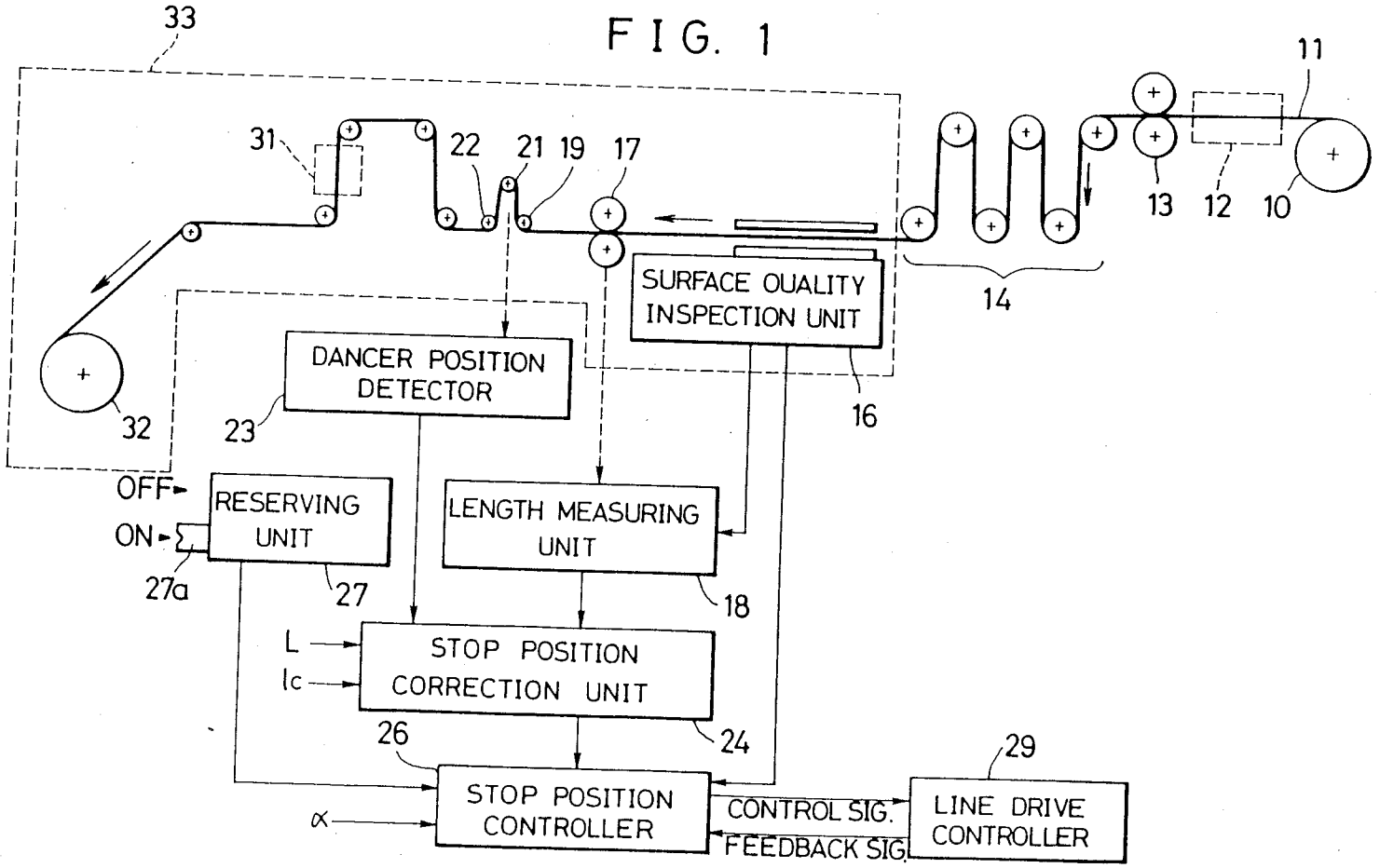
FIG. 1 is a schematic diagram showing a web drive controlling apparatus in accordance with a preferred embodiment of the present invention.

Referring to the drawings, and first to FIG. 1, a web surface inspection line equipped with a line control system in accordance with a preferred embodiment of the present invention is shown, driving a web 11 withdrawn from a roll 10 toward work rollers 13 and storage roller assembly 14 through processing station 12 including processing and coating steps. A surface quality inspection unit 16 inspects both surfaces of the web to detect surface defects. If in fact a surface defect is detected, the surface quality inspection unit 16 outputs a defect signal which in turn is transmitted to a length measuring unit 18. The web 11 is continuously driven or transported by work rollers 17 driven at a constant speed.

The length measuring unit 18 outputs length signals in accordance with the rotation of the work rollers 17 from the moment it receives the defect signal. The web 11 driven by the work rollers 17, after passing about a guide roller 19, is raised by means of a dancer roller 21. Thereafter, the web 11 changes its course downwardly and passes about a guide roller 22 so as to resume its previous course. The uppermost and lowermost positions (which are hereinafter referred to as dancer positions) between which the dancer roller 21 is raised and lowered are variable. A dancer position detector 23 continuously monitors the dancer roller 21 so as to output a position signal indicating the position of the dancer roller 21.

The web is further driven through a visual inspection station 31 wherein an operator or inspector observes both surfaces of the web 11 stopped therein. Thereafter, the web 11 is wound in a roll 32. All components disposed between the storage roller assembly 14 and the roll 32 constitute a control section 33.

The dancer position signals, as well as the length signals, are transmitted to a stop position correction unit 24 for stopping the web 11 at a proper position. The stop position correction unit 24 carries data as to a transported length L which means the whole length of the web 11 between the surface quality inspection unit 16 and the visual inspection station 31 and as to a correcting length $l_c$ which is a constant value determined in consideration of the error in stopping position caused by the web drive itself.

The stop position correction unit 24 performs a calculation from the length data and the length and dancer position signals and outputs data for stop position correction which in turn are transmitted to a stop position controller 26. The stop position controller 26 also receives the defect signal from the surface quality inspection unit 16 and an activation or authorization signal for stopping the web 11 from a reserving unit 27 which is previously manually activated if a visual inspection of the web at the visual inspection station 31 is needed. The stop position controller 26 has data as to a decelerating ratio of transportation $\alpha$ in this web drive line. The reserving unit 27 has an on-off change lever 27a. When the on-off change lever 27a is on, the reserving unit 27 outputs an activation signal for permitting the stopping of the web drive. If a defect signal is output during the presence of the activation signal from the reserving unit 27, the stop position controller 26 provides a line drive controller 29 with a control signal. The line drive controller 29 stops the rollers in the control section 33 based on the control signal and a feedback signal.

In the operation of the line control system of the web surface inspection line thus constructed, upon the occurrence of a defect signal while the reserving unit 27 is in the on-condition, the line drive controller 29 receives a control signal based on the data as to stop position correction and starts the control operation which will be hereinafter described in detail with reference to FIGS. 2 and 3.

Figure 2:
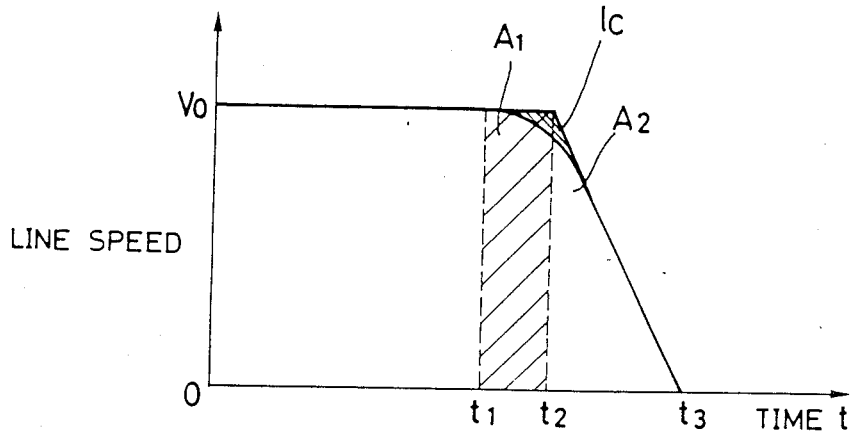
FIG. 2 is a graph showing the linear speed of a web driven along a web drive line.

FIG. 2 shows the change of line speed in the control section 33. When a defect signal is output from the surface quality inspection unit 16 at a time $t_1$, the web 11, which is traveling at a constant speed $V_o$, starts to slow down from a time $t_2$ and stops at a time $t_3$. If $A_1$ is the area of a shaded rectangle between the times $t_1$ and $t_2$ and $A_2$ the area of a triangle bounded by the curve between the times $t_2$ and $t_3$, then the following equations (1) and (2) obtain:

$$A_1 = V_o \times (t_1 - t_2) \quad (1)$$

$$A_2 = \tfrac{1}{2} \times V_o \times 1/\alpha \quad (2)$$

where the deceleration rate $\alpha$ is taken as $\alpha = 1/(t_3 - t_2)$.

For the transported length of web L, the following equation (3) obtains:

$$L = A_1 + A_2 \quad (3)$$

To prevent the web 11 from undergoing an impact due to a rapid change of speed, it is often desirable to initiate deceleration gradually. However, such a gradual deceleration will cause an error in the stopped position of the web 11. For this reason, the error in the stopped position should be corrected according to the following equation (4):

$$L = A_1 + A_2 + L_c \quad (4)$$

where $L_c$ is a correction term given as a function of a correction length $1_c$ and the line speed $V_o$.

The time $t_2$ should be advanced if the line speed $V_o$ is fast or retarded if slow.

Using this technique, stop position errors are controlled between $\pm 0.2$ and 0.5 m even taking into account the line speed $V_o$.

Figure 3:
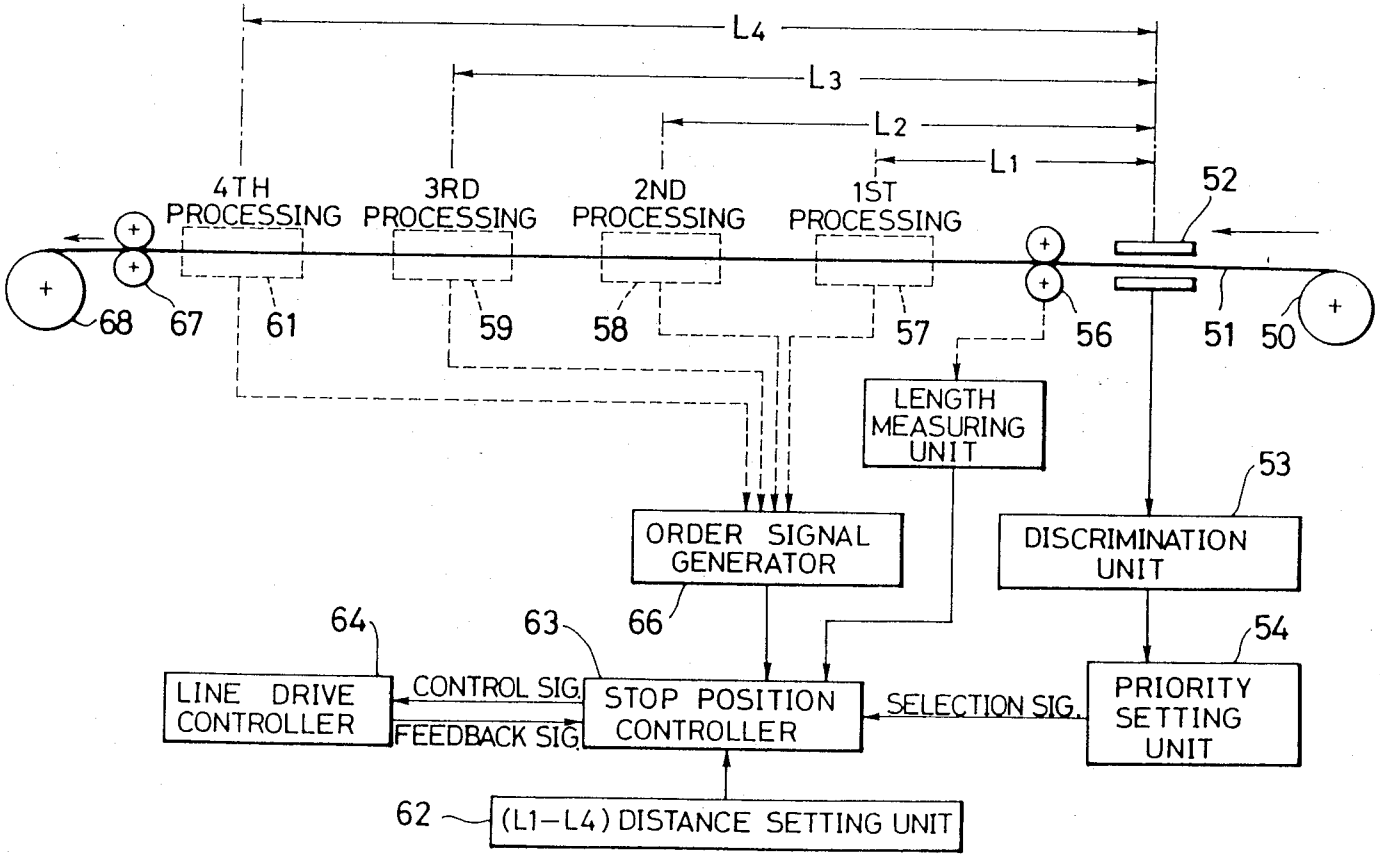
FIG. 3 is a schematic diagram showing a web drive controlling apparatus in accordance with another preferred embodiment of the present invention.

Referring now to FIG. 3, a web surface inspection line equipped with a web drive control system in accordance with another preferred embodiment of the present invention is shown, driving a web 51 withdrawn from a roll 50 toward work rollers 56. A surface defect detector 52 disposed at a discrimination point before a processing section including first to fourth processing stages 57, 58, 59 and 61 inspects a surface of the web 51 to output surface signals which in turn are sent to a web condition discrimination unit 53. This discrimination unit 53 carries data of various surface defect patterns and discriminates surface conditions of the web 51 by comparing the surface signals with the data as to surface defect patterns. A priority setting unit 54, which will be described in detail later, carries data as to priority orders which define the order of the degrees of importance of the various available remedial processes according to the surface defect patterns.

The web 51 transported by the work rollers 56 passes the first, second, third and fourth processing stages 57, 58, 59 and 61 which are respectively disposed at distances L1, L2, L3 and L4 from the discrimination point where the surface defect detector 52 is located. Data as to the distances L1 to L4 are carried by a distance setting unit 62. A stop position controller 63 provides a line drive controller 64 with a control signal based on a length signal from the work rollers 56, a priority setting signal from the priority setting unit 54, and distance data from the distance setting unit 62 in order to stop the web 11 so as to locate part of the web 11 at one of the first to fourth processing stages where the part is to be processed. The web 11 is continuously stopped until an end signal indicating the completion of an on-going processing is provided.

An order signal generator 66, upon the reception of an end signal, specifies the order of a processing stage that has provided the end signal and outputs to the stop position controller 63 an order signal indicating the order of the specified processing stage. The web 51 thus processed as needed at one or more of the processing stages is wound about the roll 6 after passing between work rollers 67.

Although the present invention has been fully described by way of a preferred embodiment thereof with reference to the accompanying drawings, it is to be noted that various changes and modifications will be apparent to those skilled in the art. Therefore, unless otherwise these changes and modifications depart from the scope of the present invention, they should be construed as included therein.

What is claimed is:

1. A web drive control apparatus for stopping a travelling web at a predetermined position with a predetermined surface conditioner of the web located in a predetermined station, comprising:

web surface inspection means for detecting a said predetermined surface condition of a surface of the web and outputting a signal indicative of said condition;

control means for decelerating and thereafter stopping said web responsive to receipt of said signal, said control means including means for measuring the length of the web that moves past said length measuring means and for stopping the web when the length of web thus measured equals the distance along the path of the web between said inspection means and said predetermined station so as to stop that part of said web wherein said surface condition was detected by said web surface inspection means at said predetermined station; and means for providing said control means with an activation signal to enable said control means to perform said deceleration of said web.

2. A web drive control apparatus as defined in claim 1, wherein said providing means is selectively manually operable to be turned off so as not to provide said activation signal.

3. A web drive line controlling apparatus as defined in claim 1, wherein said predetermined station is a visual inspection station to permit visual inspection of said part of said web.

4. A web drive line controlling apparatus as defined in claim 1, wherein said web surface inspection means is adapted to detect only significant surface defects on said surface of said web.

5. A web drive line controlling apparatus as defined in claim 1, wherein said web surface inspection means comprises a surface defect detector for detecting surface defects of said web and a pattern discriminator for discriminating a pattern of said surface defects to match said pattern with a selected one of a plurality of predetermined patterns of surface defects.

6. A web drive line controlling apparatus as defined in claim 5, wherein said predetermined station includes a plurality of processing positions arranged one after another wherein said surface of said web is subjected to at least one surface processing and each said processing position is located at a predetermined distance from said web surface inspection means to process said part of said web.

7. A web drive line controlling apparatus as defined in claim 6, further comprising means for selecting one of said plurality of predetermined processing positions according to said discriminated pattern of surface defects to provide said controlling means with a selection signal causing it to stop said web at said selected processing position.

* * * * *